US008141278B2

(12) United States Patent
Chow

(10) Patent No.: US 8,141,278 B2
(45) Date of Patent: Mar. 27, 2012

(54) STEAM IRON

(75) Inventor: Hung Chow, Zhongshan (CN)

(73) Assignee: Xiaotian (Zhongshan) Industrial Co., Ltd., Zhongshan (CN)

( * ) Notice: Subject to any disclaimer, the term of this patent is extended or adjusted under 35 U.S.C. 154(b) by 248 days.

(21) Appl. No.: 12/548,137

(22) Filed: Aug. 26, 2009

(65) Prior Publication Data

US 2010/0064557 A1 Mar. 18, 2010

(30) Foreign Application Priority Data

Sep. 17, 2008 (CN) ..... 2008 2 0147470 U

(51) Int. Cl.
*D06F 75/26* (2006.01)
*D06F 75/08* (2006.01)

(52) U.S. Cl. ..... 38/77.7

(58) Field of Classification Search ..... 219/250; 38/74–77.83

See application file for complete search history.

(56) References Cited

U.S. PATENT DOCUMENTS

| | | | | | |
|---|---|---|---|---|---|
| 4,661,685 | A * | 4/1987 | Contri | 219/250 |
| 4,686,352 | A * | 8/1987 | Nawrot et al. | 219/250 |
| 4,833,297 | A * | 5/1989 | Del Fresno | 219/250 |
| 5,042,179 | A * | 8/1991 | van der Meer | 38/77.83 |
| 5,624,023 | A * | 4/1997 | Chasen et al. | 200/526 |
| 5,751,074 | A * | 5/1998 | Prior et al. | 307/118 |
| 6,720,537 | B2 * | 4/2004 | Prager | 219/506 |
| 2006/0086712 | A1 * | 4/2006 | Feldmeier | 219/250 |
| 2010/0043258 | A1 | 2/2010 | Chow | |

* cited by examiner

*Primary Examiner* — Ismael Izaguirre
(74) *Attorney, Agent, or Firm* — Hamre, Schumann, Mueller & Larson, P.C.

(57) ABSTRACT

The present invention discloses a steam iron which includes an iron body, a steam generation device disposed in the iron body, and an operation sensing device electrically connected to steam generation device. Compared with the existing technologies, in the present invention, an additional operation sensing device is electrically connected to the steam generation device. When the user operates the steam iron, the operation sensing device can transmits operating signals to the steam generation device which thus starts to work. When the iron is not operated, the steam generation device doesn't work because no operating signal is transmitted to the operation sensing device, thereby reducing energy and enhancing safety.

3 Claims, 2 Drawing Sheets

STEAM IRON

TECHNICAL FIELD

The present invention relates to field of steam irons and, more particularly to a steam iron controlled by an operating signal.

BACKGROUND

In existing technologies, steam irons generally include an iron body and a steam generation device disposed in the iron body. The steam generation device contains a water box, a water pump connected to the water box, a vaporizing chamber connected to the water pump, a steam outlet at a bottom of iron body, and a heating pipe located in the vaporizing chamber. The working process of steam iron is that, the water pump pumps the water in the water box into the vaporizing chamber where the heating pipe heats the water and generates steam. The steam is discharged out of the steam outlet at the bottom of iron body. In the course of using the steam iron, the user often needs to erect it but the power supply for the water pump is not switched off. This, as a result, leads to a waste of electric energy and hidden danger to personal safety.

In addition, the thermometers in the existing steam irons use a mechanical thermometer, which may results in great errors from real temperature, and accordingly form damage to the clothing.

SUMMARY

The existing steam irons may lead to a waste of electric energy and hidden danger to personal safety.

The technical solution of the present invention is to provide a steam iron. The steam iron comprises an iron body, a steam generation device disposed in the iron body, and an operation sensing device electrically connected to the steam generation device.

Compared with the existing technologies, in accordance with the present invention, an operation sensing device is provided and connected to the steam generation device. When the user operates the steam iron, the operation sensing device transmits an operating signal to the steam generation device which thus comes into operation. When the steam iron is not operated, no operating signal is transmitted to the operation sensing device and then the steam generation device doesn't work. Therefore, the steam iron requires a reduced energy and has an enhanced safety.

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the present invention.

Figure 1:
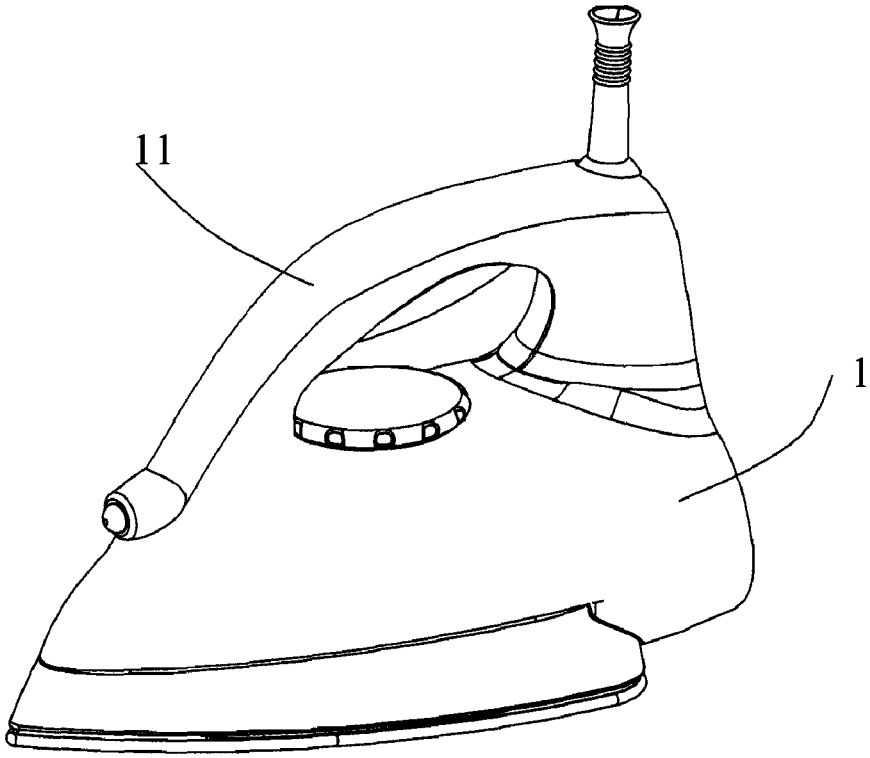
FIG. 1 is a three-dimensional structural schematic view of a preferred embodiment of the present invention.
Figure 2:
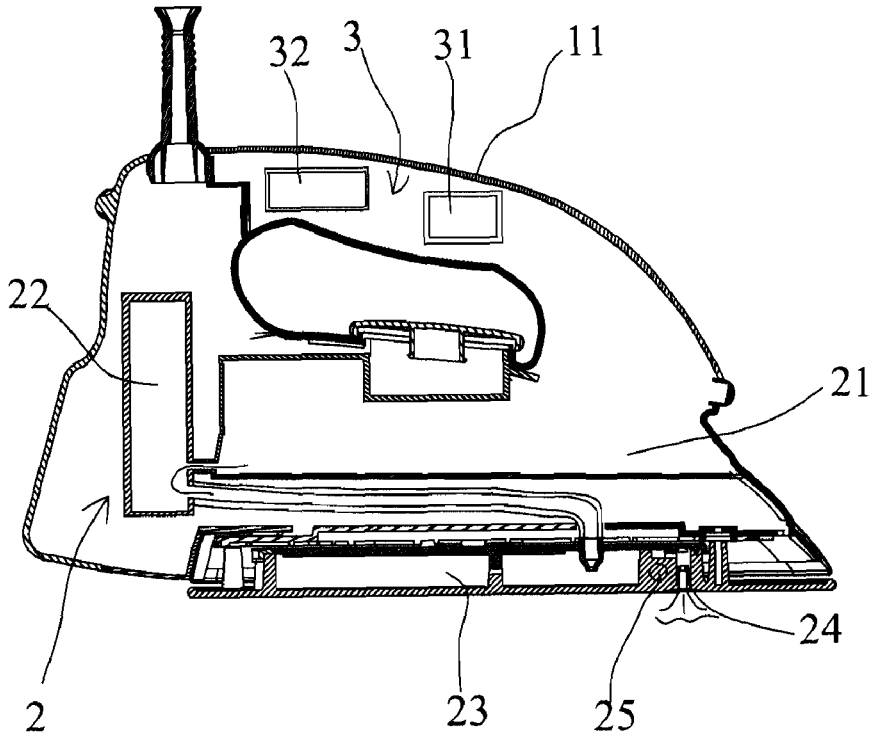
FIG. 2 is a cutaway, structural side view of the embodiment in FIG. 1.
Figure 3:
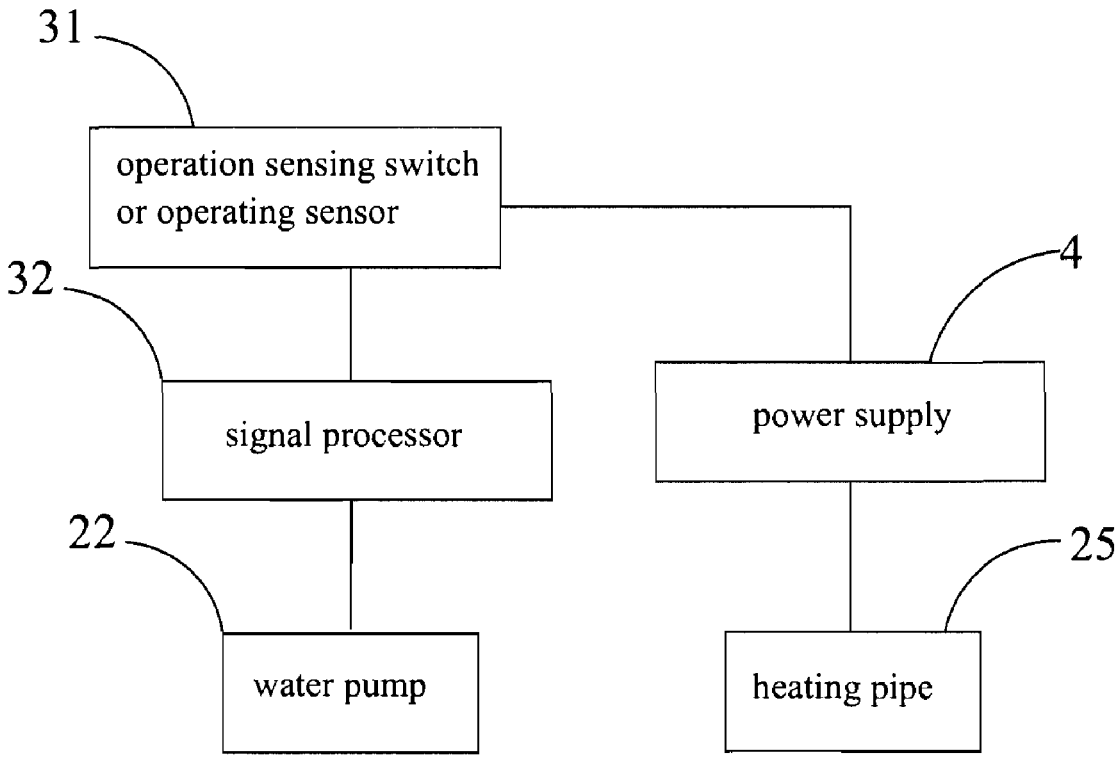
FIG. 3 is a function block diagram of a circuit in the embodiment in FIG. 1.

FIGS. 1 through 3 show a steam iron in accordance with a preferred embodiment of the present invention. The steam iron includes an iron body 1, a steam generation device 2 disposed in iron body 1 and an operation sensing device 3 electrically connected to steam generation device 2. In this way, an operation sensing device 3 is provided and connected to the steam generation device 2. When the user operates the steam iron, the operation sensing device transmits an operating signal to the steam generation device 2 which thus comes into operation. When the steam iron is not operated, no operating signal is transmitted to the operation sensing device 3 and then the steam generation device 2 doesn't work, thereby reducing energy and enhancing safety. The above components are described in detail as follows.

The operation sensing device 3 includes an operation sensing switch or operation sensor 31 and a signal processor 32. One end of the signal processor 32 is electrically connected to the operation sensing switch or operation sensor 31, and the other end is electrically connected to the steam generation device 2. The operation sensing switch or operation sensor 31 may be a pendulum-type micro inertial sensor. When the user operates the iron, the pendulum-type needle in the operation sensing switch or operation sensor 31 swings, and simultaneously the operation sensing switch or operation sensor 31 transmits operating signals to the steam generation device 2 which thus comes into operation. When the iron is not operated, the steam generation device 2 doesn't work without operating signal. The iron body 1 includes a handle 11 which has a cylindrical space. The operation sensing device 3 is disposed in the cylindrical space of the handle 11 so that the operation sensing device 3 can receive the operating signals better. Certainly, the operation sensing device 3 could be disposed at other positions within the iron body 1 or outside the iron body 1.

The steam generation device 2 includes a water box 21, a water pump 22 connected to water box 21, a vaporizing chamber 23 connected to water pump 22, a steam outlet 24 disposed at the bottom of iron body 1, and a heating pipe 25 in the vaporizing chamber 23. The operation sensing switch or operation sensor 31 transmits the operating signals to control the power supply 4 and thus start or stop the water pump 22. The structure and operating principle of other parts of the steam generation device 2 is the same as those of the existing steam generation device. So there is no need to give detailed description to those parts.

A temperature sensor (not shown) is disposed in the vaporizing chamber 23, so as to control the steam temperature accurately and prevent the steam from damaging the clothing.

The foregoing description serves as preferred embodiments of the present invention but it should not be construed as limiting the overall scope of the present invention. It will be apparent that various modifications, replacements and variations may be made thereto without departing from the spirit and scope of the invention. All changes which come within the meaning and range of equivalency of the claims are to be embraced within their scope.

What is claimed is:

1. A steam iron comprising:

an iron body including a handle having a cylindrical space;

a steam generation device disposed in the iron body; and an operation sensing device disposed in the cylindrical space of the handle and electrically connected to the steam generation device, wherein the operation sensing device includes an operation sensing switch or operating sensor and a signal processor, wherein one end of the signal processor is electrically connected to the operation sensing switch, and another end of the signal processor is electrically connected to the steam generation device, wherein the operation sensing switch or operating sensor is a pendulum-type micro inertial sensor, and wherein a pendulum-type needle in the pendulum-type micro inertial sensor swings back and forth when the steam iron is being operate, simultaneously, the pendulum-type micro inertial sensor transmits an operating signal to the steam generation device and causes the steam generation device to generate steam.

2. The steam iron of claim 1, wherein the steam generation device comprises a water box, a water pump connected to the water box, a vaporizing chamber connected to the water pump, a steam outlet disposed at a bottom of the iron body, and a heating pipe within a vaporizing chamber.

3. The steam iron of claim 2, wherein a temperature sensor is disposed in the vaporizing chamber.

* * * * *